US008597214B2

(12) United States Patent
Von Holgreen

(10) Patent No.: US 8,597,214 B2
(45) Date of Patent: Dec. 3, 2013

(54) APPARATUS AND METHOD FOR DEEP VEIN THROMBOSIS PROPHYLAXIS

(76) Inventor: Jared Von Holgreen, Pleasant Grove, UT (US)

( * ) Notice: Subject to any disclaimer, the term of this patent is extended or adjusted under 35 U.S.C. 154(b) by 965 days.

(21) Appl. No.: 12/541,838

(22) Filed: Aug. 14, 2009

(65) Prior Publication Data

US 2011/0040220 A1 Feb. 17, 2011

(51) Int. Cl.
*A61H 15/00* (2006.01)

(52) U.S. Cl.
USPC ..... 601/149; 601/148; 601/150

(58) Field of Classification Search
USPC ..... 601/148–152; 606/201–202; 128/DIG. 20; 602/13
See application file for complete search history.

(56) References Cited

U.S. PATENT DOCUMENTS

| | | | | |
|---|---|---|---|---|
| 4,841,956 | A * | 6/1989 | Gardner et al. | 601/152 |
| 5,443,440 | A * | 8/1995 | Tumey et al. | 601/152 |
| 6,290,662 | B1 * | 9/2001 | Morris et al. | 601/149 |
| 6,292,985 | B1 * | 9/2001 | Grunberger | 24/303 |
| 6,319,215 | B1 * | 11/2001 | Manor et al. | 601/152 |
| 6,592,534 | B1 * | 7/2003 | Rutt et al. | 601/151 |
| 7,833,184 | B2 * | 11/2010 | Chiodo et al. | 602/27 |
| 7,947,003 | B2 * | 5/2011 | Bonnefin et al. | 601/150 |

* cited by examiner

*Primary Examiner* — Patricia Bianco
*Assistant Examiner* — Camtu Nguyen
(74) *Attorney, Agent, or Firm* — Workman Nydegger

(57) ABSTRACT

Apparatus for promoting blood flow in an extremity is disclosed including a gas source and a bladder assembly including a first bladder and a second bladder independently coupled to the gas source. The bladder assembly may be sized to fit within a shoe of a patient and may include a first bladder encircling a second bladder. A controller is operably coupled to the gas source and is configured to control the flow of gas from the gas source to the first and second bladders in order to periodically commence inflation of the first and second bladders in sequence.

37 Claims, 6 Drawing Sheets

APPARATUS AND METHOD FOR DEEP VEIN THROMBOSIS PROPHYLAXIS

BACKGROUND OF THE INVENTION

1. The Field of the Invention

This application relates to an apparatus and method for the treatment of deep vein thrombosis, and, more particularly, to devices for applying an external compressive force to the lower extremities to promote blood flow.

2. The Relevant Technology

Contraction and relaxation of the muscles of the calf is responsible for the majority of movement of blood out of the lower extremities through the veins, hence venous circulation becomes stagnant when the calf muscles are at rest, increasing risk for deep venous thrombosis (DVT).

Gravity likewise plays a role in venous circulation. Long periods of sitting or standing create pressure on the valves within the veins of the legs. Over time, these valves can break allowing blood to pool in the veins of the calf. This process known as deep venous insufficiency (DVI) is a lifelong disease process with no surgical solution.

To decrease the risk of venous thrombosis while hospitalized, segmental pressure devices have been created, such as the apparatus marketed under the trade name PLEXIPULSE. These devices are proven to lower incidence of clotting while immobile. However, these devices are bulky, non portable, and expensive, making them impractical for home use or daily wear. These devices are therefore ineffective for aiding in the prevention of DVI through daily use.

Patients with DVI may be treated using medical compression stockings, which are an elastic stocking with graded compression, such as compression stocking offered for sale under the trade name MEDIVEN. These stockings often cause patients discomfort due to the tight compression and thick material. The tight compression also causes the compression stockings to be difficult to put on, requiring in some instances aid from a mechanical device to put the stocking over the heel of the foot.

It is known that both DVI and DVT may be controlled by applying cyclical pressure to a person's lower extremities to aid in venous blood flow. Currently available devices use bulky, non-portable motors and include complex cuffs and bladders that wrap entirely around a person's leg. Devices of this type are not readily portable and are not meant to be worn during a person's normal daily activities. Examples of such devices are described in U.S. Pat. Nos. 5,263,473; 5,014,681 and 5,674,262.

Another example of such a device is described in U.S. Pat. No. 6,290,662, which describes a boot formed of an inelastic material which completely surrounds the foot and a single-chambered bladder is positioned within the boot. This device is cumbersome and does not permit a person to wear normal shoes. This oversight makes the device impractical for daily wear and will tend to lead to poor patient compliance. Furthermore, surrounding any extremity with a rigid inelastic material inhibits movement and gives no room for swelling thus inhibiting circulation and increasing the risk for DVT, as well as being painful to those with severe DVI and foot swelling.

BRIEF SUMMARY OF THE INVENTION

These and other limitations may be overcome by embodiments of the present invention, which relate generally to medical devices and methods for promoting circulation in an extremity, such as a foot.

In one aspect of the invention, an apparatus for promoting circulation in an extremity in accordance with an embodiment of the present invention includes a gas source and a bladder assembly including a first bladder and a second bladder independently coupled to the gas source. The bladder assembly may be sized to fit within a shoe of a patient and may further be sized to occupy all or less than an instep portion of the patient's shoe. The first bladder may encircle the second bladder, such as a plane generally parallel to the sole of a shoe in which the bladder assembly is mounted.

In another aspect of the invention, a controller is operably coupled to the gas source and is configured to control the flow of gas from the gas source to the first and second bladders in order to periodically inflate the first and second bladders.

In another aspect of the invention, the controller is configured to first commence inflation of the first bladder followed by commencing inflation of the second bladder. The controller may further be configured to maintain the first and second bladders in an inflated state prior to permitting deflation of the first and second bladders.

These and other advantages and features of the present invention will become more fully apparent from the following description and appended claims, or may be learned by the practice of the invention as set forth hereinafter.

BRIEF DESCRIPTION OF THE DRAWINGS

To further clarify at least some of the advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE EMBODIMENTS

Figure 1:
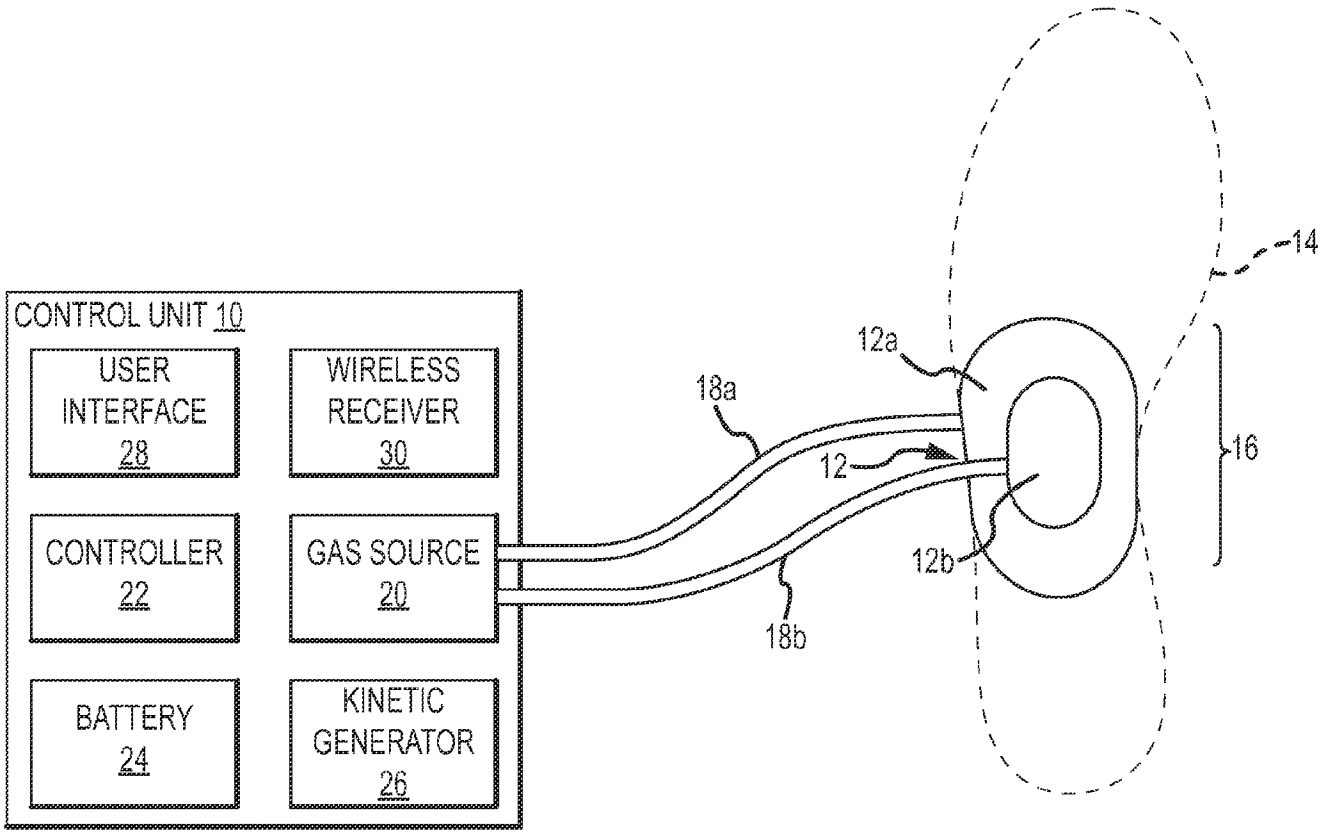
FIG. 1 illustrates a schematic block diagram of an apparatus for promoting circulation in an extremity in accordance with an embodiment of the present invention.

Referring to FIG. 1, a control unit 10 and bladder assembly 12 according to embodiments of the invention provide for deep vein insufficiency (DVI) and deep vein thrombosis (DVT) prophylaxis. The bladder assembly 12 is positionable adjacent a patient's foot 14, such as under the arch of the patient's foot 14 such that the bladder assembly 12 may apply pressure to the deep veins within the sole of the foot upon inflation. For example, the bladder assembly 12 may be positioned under the deep plantar venous arch of the foot. In some embodiments, the bladder assembly is sized to occupy an area equal or less than the instep 16 of the patient's foot, such as all or less than the area between the metatarsal-phalangeal joint and the talo-navicular and calcaneocuboid joints.

The bladder assembly 12 may include a first bladder 12*a* and a second bladder 12*b* each in fluid communication with a supply tube 18*a*, 18*b*, respectively. In the illustrated embodiment the first bladder portion 12*a* encircles the second bladder 12*b*, however, other relative sizes and shapes are possible. In the illustrated embodiment the first bladder portion 12*a* encircles the second bladder 12*b* in a plane generally parallel to the sole of a shoe in which the bladder assembly is removably mounted.

The supply tubes 18*a*, 18*b* provide parts of fluid paths in fluid communication with a gas source 20 for selectively filling the first and second bladders 12*a*, 12*b* with pressurized air, or other fluid. The gas source 20 is controlled by a controller 22 that may be embodied as an electronic circuit, general purpose central processing unit (CPU), mechanical regulator, or other device suitable for the timed control of fluid flow.

The controller 22 controls the flow of gas from the gas source 20 to the bladders 12*a*, 12*b* in order to periodically apply pressure to the plantar veins of the patient's foot 14. The cyclic application of pressure encourages blood flow out of the lower extremities and relieves pressure on the valves within the veins of the legs, thereby reducing the conditions conducive to the development of DVI and DVT as discussed hereinabove.

The controller 22 and gas source 20 may be coupled to a battery 24 providing electrical power. The battery 24 may be charged by means of a kinetic generator 26 operable to generate electrical energy based on movement of the generator 26. For example, any of the class of devices including a spring mounted magnet positioned within a conductive coil may serve as the kinetic generator 26. Alternatively, the battery 24 may be a replaceable alkaline battery or a rechargeable battery chargeable by an external source such that the kinetic generator 26 may be eliminated.

The controller 22 may receive inputs from a patient using the control unit 10 and bladder assembly 12 or a medical professional treating the patient. Inputs may be received by means of one or both of a user interface 28 or a wireless receiver 30 operable to receive infrared signals or signals according to a wireless communication protocol such WiFi, WiMax, Bluetooth, and the like.

Figure 2:
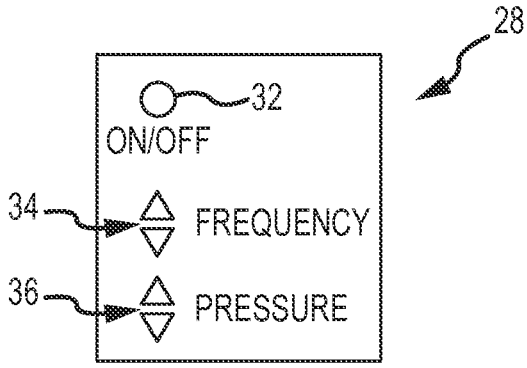
FIG. 2 illustrates a user interface for a controlling an apparatus for promoting circulation in an extremity in accordance with an embodiment of the present invention.

Referring to FIG. 2, in one embodiment, the user interface 28 may include such inputs as an on/off button 32, a frequency input 34 enabling an operator to input the frequency with which the bladders 12*a*, 12*b* are inflated, and a pressure input 36 enabling an operator to input the pressure to which the bladders 12*a*, 12*b* will be inflated. Alternatively, the inputs to turn on the device or alter the inflation frequency and pressure may be received by the wireless receiver 30 from a remote control device capable of receiving the same inputs as the user interface 28 and translating the inputs to wireless signals. Use of a remote control device may advantageously allow a user to adjust the device without bending down, which may be advantageous for patients having limited mobility. Use of a remote control also advantageously allows a patient to turn off the device while walking when the artificial pumping of the device may not be needed. Further, the frequency and/or pressure of the bladders 12*a*, 12*b* can be controlled or set separately, together, or independently. For instance, the pressure of the bladder 12*a* can be set higher or lower than the pressure of the bladder 12*b* and/or at a different frequency.

In some embodiments, the controller 22 may be programmed to prevent a user from adjusting the pressure and/or frequency of inflation of the bladders 12*a*, 12*b* to levels that are non-therapeutic. For example, the controller 22 may be programmed to enable a user to alter the inflation frequency to once every two to five minutes but no less than once every five minutes. The controller 22 may also be programmed to enable adjustment of the inflation pressure from 65 mmHg to 100 mmHg but not less than 65 mmHg. Such adjustments enable the operation of the device to be tuned to conserve battery life or to suit a patient's condition but prevent adjustment to the point that therapeutic benefits are no longer being achieved. In still other embodiments, pressure and frequency adjustments are not permitted by the controller 22 in order to prevent adjustment to non-therapeutic levels.

Figure 3:
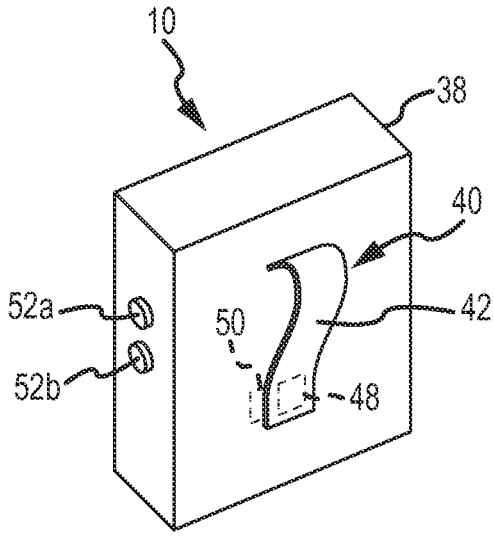
FIG. 3 illustrates a housing for mounting a control unit of an apparatus for promoting circulation in an extremity in accordance with an embodiment of the present invention.
Figure 4:
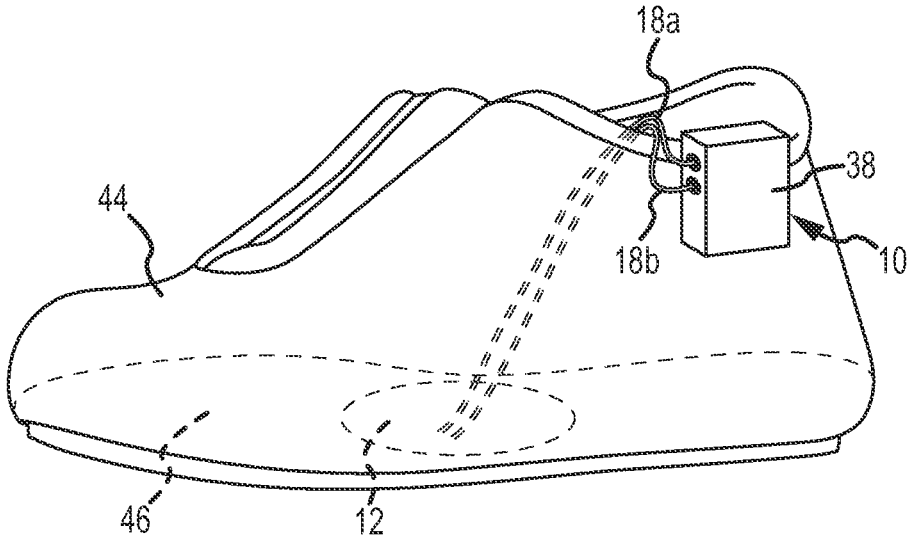
FIG. 4 illustrates the housing of FIG. 3 mounted to a shoe in accordance with an embodiment of the present invention.

Referring to FIGS. 3 and 4, the control unit 10 may include a housing 38 containing some or all of the components of the control unit 10 discussed hereinabove. A fastener 40 may secure to the housing to selectively secure the housing 38 to a patient or to an item of the patient's clothing. For example, the fastener 40 may be embodied as a resilient clip 42 such that a portion of the patient's footwear 44, or other clothing, may be captured between the clip 42 and the housing 38 to secure the housing 38 to the patient's footwear 44 having the bladder assembly 12 positioned on the insole 46 of the footwear 44 such that the bladder assembly 12 will engage the instep 16 of a patient's foot 14 inserted within the footwear 44. In some embodiments, the bladder assembly may be fastened to or integrally formed with the insole 46. In other embodiments, the bladder assembly 12 is removably placed over the insole 46 either with or without the use of fasteners, such as a hook and loop fastening system such as VELCRO. The supply tubes 18*a*, 18*b* have sufficient length to extend between the bladder assembly 12 positioned on the insole 46 and the housing 38 clipped to the footwear, such as the laces or upper of the footwear 44. In some embodiments, a magnet 48 may be mounted to the clip 42 adjacent a corresponding magnet 50 mounted to the housing 38 such that magnetic attraction between the magnets 48, 50 augments the biasing force of the clip 42.

The supply tubes 18*a*, 18*b* may couple to ports 52*a*, 52*b* either protruding from or accessible within housing 38 and in fluid communication with the gas source 20. For example, the ports 52*a*, 52*b* may include any toolless pneumatic coupler known in the art such that the supply tubes 18*a*, 18*b* can be readily connected to and disconnected from the ports 52*a*, 52*b*. A patient may use differently sized supply tubes 18*a*, 18*b* depending on the type of footwear with which the control unit 10 and bladder assembly 12 are used. A patient may use longer supply tubes 18*a*, 18*b* when wearing tall boots, for example.

Figure 5:
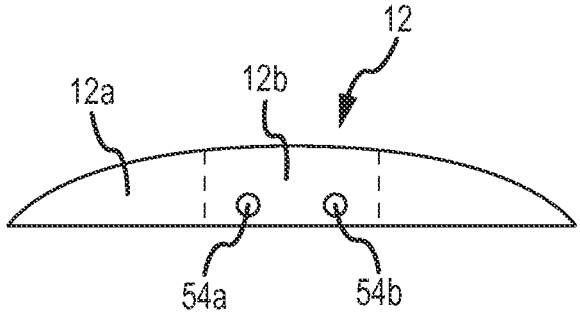
FIG. 5 illustrates ports of a bladder assembly for promoting circulation in an extremity in accordance with an embodiment of the present invention.

Referring to FIG. 5, the bladder assembly 12 may likewise include ports 54*a*, 54*b* in fluid communication with the bladders 12*a*, 12*b* respectively. The ports 54*a*, 54*b* may likewise include any toolless pneumatic coupler known in the art such that the supply tubes 18*a*, 18*b* can be readily connected to and disconnect from the ports 54*a*, 54*b*.

Figure 6B:
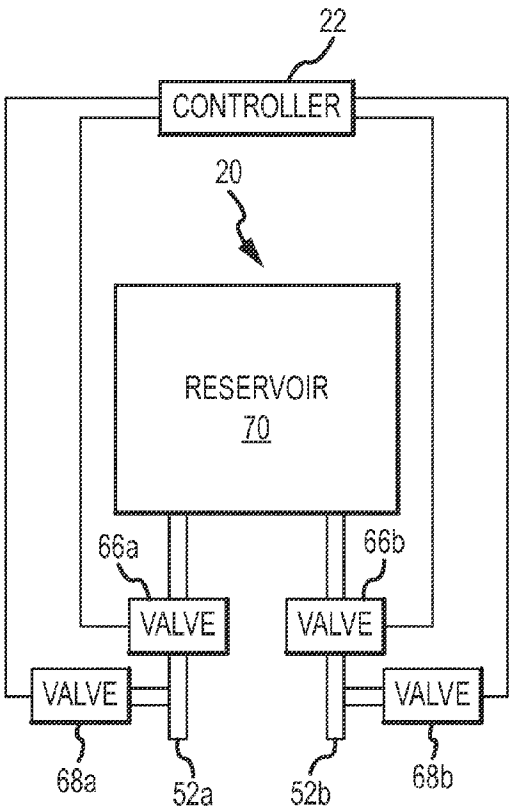
FIGS. 6A through 6C illustrate gas sources suitable for inflation of a bladder assembly to promote circulation in an extremity in accordance with an embodiment of the present invention.
Figure 6A:
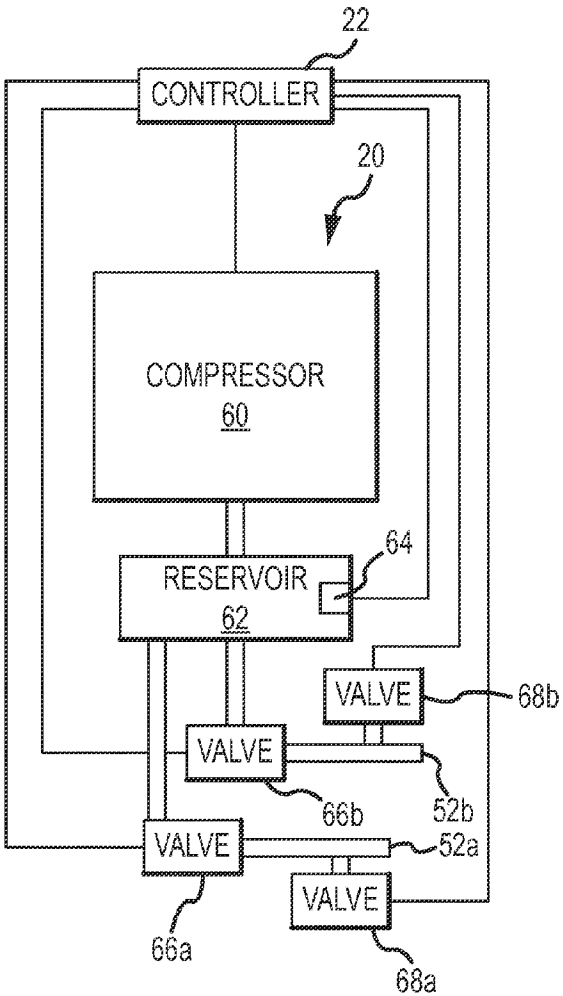

Referring to FIG. 6A, in some embodiments, the controller 22 is operable to control power supplied to a gas source 20 embodied as a compressor 60. The compressor 60 may be a miniature energy efficient compressor, such as that used in the wrist mounted blood pressure device marketed under the trade name RELION. In some embodiments, the compressor 60 is capable of generating pressures of about 65 mmHg or more. The compressor 60 may be coupled to a reservoir 62 storing pressurized gas. A pressure sensor 64 may be positioned within the reservoir 62 and output to the controller of the pressure within the reservoir 62. The controller 22 may be programmed to control power supplied to the compressor 60 in order to maintain the gas within the reservoir 62 at a specified pressure based on the output of the pressure sensor 64.

Electrically actuated valves 66*a*, 66*b* may have inputs in fluid communication with the reservoir 62. Alternatively, the valves 66*a*, 66*b* have inputs in direct fluid communication with the compressor 60 and the reservoir 62 may be eliminated. Outputs of the valves 66*a*, 66*b* are selectively placed in fluid communication with the supply tubes 18*a*, 18*b*, such as by means of coupling the supply tubes 18*a*, 18*b* to the ports 52*a*, 52*b*. The controller 22 may open the electrically actuated valves 66*a*, 66*b* in order to supply pressurized gas to the bladders 12*a*, 12*b* in a cyclical manner. Deflation of the bladders 12*a*, 12*b* may be accomplished by turning off power to the compressor 60 while the valves 66*a*, 66*b* are maintained open such that gas is allowed to leak through the compressor 60 from the bladders 12*a*, 12*b*. Alternatively, the valves 66*a*, 66*b* may have two states—one in which the compressor 60 or reservoir 62 is in fluid communication with the bladders 12*a*, 12*b* and another in which the bladders 12*a*, 12*b* are placed in fluid communication with the atmosphere and fluid flow from the compressor 60 or reservoir 62 is substantially cut off.

In yet another alternative embodiment, electrically actuated relief valves 68*a*, 68*b* may be placed in fluid communication with the ports 52*a*, 52*b* downstream from the valves 66*a*, 66*b*. The controller 22 may be programmed to close the valves 66*a*, 66*b* and then open the relief valves 68*a*, 68*b* to vent air from the bladders 12*a*, 12*b*. The controller 22 may be further programmed to close the relief valves 68*a*, 68*b* prior to opening of the valves 66*a*, 66*b*.

Referring to FIG. 6B, in an alternative embodiment, the compressor 60 may be eliminated and a reservoir 70 may be placed in fluid communication with the valves 66*a*, 66*b*. The reservoir 70 may be readily replaceable, such as a $CO_2$ cartridge. In such embodiments, the valves 66*a*, 66*b* may be actuated by the controller 22 to place the reservoir 70 in fluid communication with the supply tubes 18*a*, 18*b* in order to inflate the bladders 12*a*, 12*b*. In such embodiments, the bladders 12*a*, 12*b* may be deflated by means of relief valves 68*a*, 68*b* that are opened after the valves 66*a*, 66*b* are closed in order to vent air from the bladders 12*a*, 12*b*. The relief valves 68*a*, 68*b* may be closed before opening the valves 66*a*, 66*b*. Alternatively, relief valves 68*a*, 68*b* may be eliminated and the valves 66*a*, 66*b* may have two states—one in which the reservoir 70 is in fluid communication with the bladders 12*a*, 12*b* and another in which the bladders 12*a*, 12*b* are placed in fluid communication with the atmosphere and fluid flow from the reservoir 70 is substantially cut off.

Figure 6C:
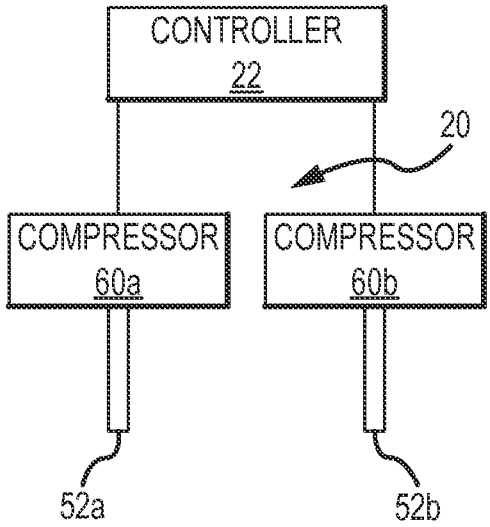

Referring to FIG. 6C, in yet another alternative embodiment, the valves 66*a*, 66*b* are eliminated and two compressors 60*a*, 60*b* are used, each controlled by the controller 22 to provide independent inflation of the bladders 12*a*, 12*b*. In such embodiments, deflation of the bladders 12*a*, 12*b* may be accomplished by turning off the compressors 60*a*, 60*b* and allowing gas to leak from the bladders 12*a*, 12*b* through the compressors 60*a*, 60*b*.

Figure 7A:
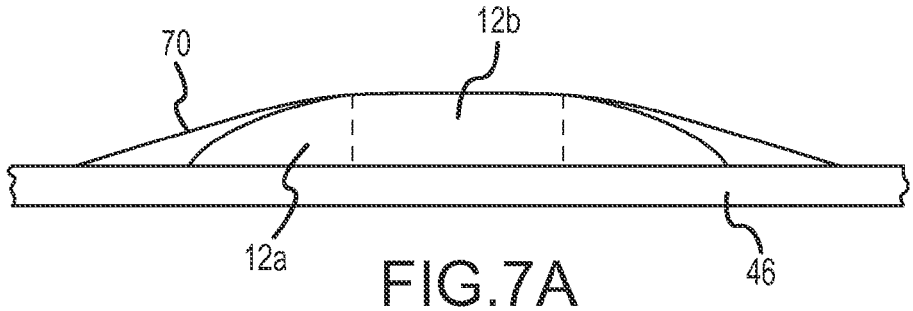
FIGS. 7A through 7C illustrate a method for inflating a bladder assembly to promote circulation in an extremity in accordance with an embodiment of the present invention.
Figure 7B:
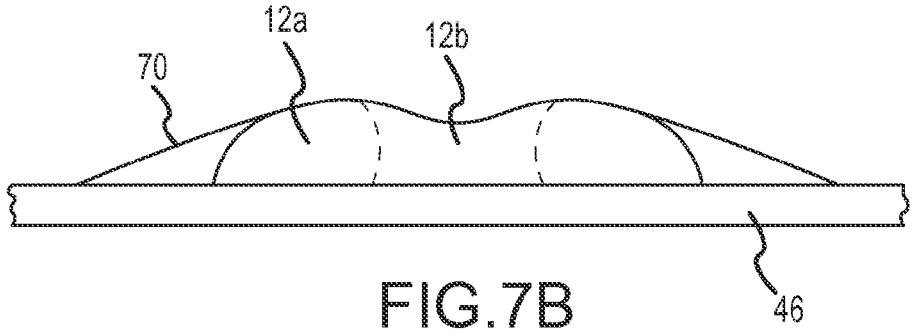
Figure 7C:
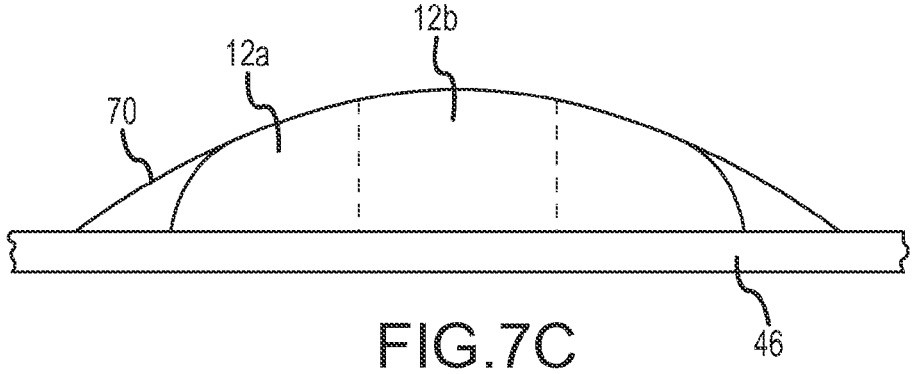

Referring to FIGS. 7A-7C, the bladders 12*a*, 12*b* may be periodically inflated according to the illustrated method in order to more effectively increase blood flow through the lower extremities. In some embodiments, the bladders 12*a*, 12*b* are independently inflated sequentially. Referring to specifically to FIG. 7A, in use the bladder assembly 12 is positioned on the insole 46 of the patient's footwear 44 such that the lower surface 70 of the patient's foot 14 rests on the bladder assembly 12, with or without an intervening covering such as stockings, nylons, or the like. As noted above, the bladder assembly 12 may be positioned to apply pressure to the plantar veins, such as the deep plantar venous arch. As shown in FIG. 7A, the bladder assembly 12 is initially deflated. The bladder assembly 12 may be removably positioned within the footwear 44 such that the bladder assembly 12 may be used with different pairs of shoes. The bladder assembly 12 may also be available in multiple sizes to accommodate different sizes of feet and different types of shoes.

Referring to FIG. 7B, the controller 22 may then cause the gas source 20 to inflate the bladder 12*a*, such as by performing one or both of opening the valve 66*a* or powering a compressor 60 or 60*a*. As noted above, the bladder 12*b* may encircle the bladder 12*a*. Inflation of the bladder 12*a* may therefore result in pooling of blood within the area of the patient's foot 14 encircled by the bladder 12*a*.

Referring to FIG. 7C, following inflation of the bladder 12*a*, the bladder 12*b* may be inflated, such as by performing one or both of opening the valve 66*b* or powering a compressor 60 or 60*b*. Inflation of the bladder 12*b* may commence following commencement of inflation of the bladder 12*a* either before or after the bladder 12*a* is completely inflated. For example, the controller 22 may commence inflation of the bladder 12*b* following a wait period of between about 0.5 and 3 seconds following commencement of inflation of the bladder 12*a*. In the illustrated embodiment, the bladder 12*a* remains inflated while the bladder 12*b* is inflated, such as by keeping the valve 66*a* open or continuing to power a compressor 60*a*. Inflation of the bladder 12*b* following inflation of the bladder 12*a* may increase effectiveness of the device as blood that is pooled within the opening defined by the bladder 12*a* during inflation of the bladder 12*a* is forced out during inflation of the bladder 12*b*.

Referring again to FIG. 7A, following inflation of the bladder 12*b*, the bladders 12*a*, 12*b* may then be permitted to deflate. In some embodiments, the bladders 12*a*, 12*b* are permitted to deflate following a wait period, such as a period of between about 1 and 5 seconds, or between about 2 and 3 seconds. Typically the elasticity of the bladders 12*a*, 12*b* and the weight of the patient's foot 14 are used to force air from the bladders 12*a*, 12*b*. As noted above, air may be allowed to escape from the bladders 12*a*, 12*b* according to various methods, such as by turning off power to compressors 60*a*, 60*b*, leaving the valves 66*a*, 66*b* open while the compressor 60 is unpowered, closing the valves 66*a*, 66*b* and opening relief valves 68*a*, 68*b*, or by changing the valves 66*a*, 66*b* to a state that vents the bladders 12*a*, 12*b* to the atmosphere. Following deflation of the bladders 12*a*, 12*b*, the bladders 12*a*, 12*b* may be again inflated as shown in FIGS. 7B and 7C according to a frequency specified by the controller 22. For example, in one therapeutic regime the bladders are inflated about every one to five minutes, or about every two to three minutes.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for promoting venous circulation in a lower extremity of a patient comprising:

a gas source;

a bladder assembly comprising a first bladder coupled to the gas source by a first fluid path and a second bladder coupled to the gas source by a second fluid path, wherein first bladder encircles the second bladder, the bladder assembly being removably mounted to an insole of a patient's footwear;

a controller operably coupled to the gas source and configured to control flow of gas from the gas source to periodically commence inflation of the first bladder followed by commencement of inflation of the second bladder, the controller being removably secured to the patient's footwear.

2. The apparatus of claim 1, further comprising:

a housing, the gas source and controller mounted within the housing; and a fastener secured to the housing.

3. The apparatus of claim 2, wherein the fastener comprises a resilient clip.

4. The apparatus of claim 3, wherein the fastener further comprises a first magnet secured to the resilient clip and a second magnet secured to the housing opposite the first magnet.

5. The apparatus of claim 1, further comprising a user interface in data communication with the controller.

6. The apparatus of claim 5, wherein the user interface is configured to receive frequency adjustments and pressure adjustments.

7. The apparatus of claim 6, wherein the controller is configured to allow pressure adjustments only within a predetermined pressure range and to allow frequency adjustments only within a predetermined frequency range.

8. The apparatus of claim 7, wherein the predetermined pressure range is 65 to 100 mmhg and wherein the predetermined frequency range is once every two to five minutes.

9. The apparatus of claim 1, wherein the gas source comprises a first compressor coupled to the first fluid path and a second compressor coupled to the second fluid path; and wherein the controller is operably coupled to the first and second compressors and configured to selectively and independently turn on the first and second compressors to control inflation of the first and second bladders.

10. The apparatus of claim 1, wherein the gas source comprises a gas reservoir and wherein the first fluid path includes a first electrically controlled valve and the second fluid path includes a second electrically controlled valve; and wherein the controller is operably coupled to the first and second electrically controlled valves and configured to control opening and closing of the first and second electrically controlled valves.

11. The apparatus of claim 10, further comprising a first electrically controlled relief valve in fluid communication with the first fluid path at a point between the first electrically controlled valve and the first bladder and a second electrically controlled relief valve in fluid communication with the second fluid path at a point between the second electrically controlled valve and the second bladder;

wherein the controller is operably coupled to the first and second electrically controlled relief valves and configured to control opening and closing of the first and second electrically controlled relief valves to cause deflation of the first and second bladders.

12. The apparatus of claim 1, wherein the bladder assembly is sized to occupy an instep of the patient's footwear.

13. The apparatus of claim 1, wherein the controller is configured to control the gas source effective to:

commence inflating the first bladder following a first wait period after a previous inflation of the first bladder;

commence inflating the second bladder following a second wait period after commencement of inflation of the first bladder;

maintain the first and second bladder in an inflated state for a third wait period; and permit deflation of the first bladder and second bladder.

14. The apparatus of claim 1, wherein the gas source comprises a compressor and wherein the first fluid path includes a first electrically controlled valve and the second fluid path includes a second electrically controlled valve, the controller being operably coupled to the first and second electrically controlled valves and configured to control opening and closing of the first and second electrically controlled valves.

15. A method for promoting venous circulation in a lower extremity of a patient comprising:

positioning a bladder assembly over an insole of a patient's footwear, said bladder assembly comprising a first bladder and a second bladder, wherein the second bladder completely encircling the first bladder in a plane parallel to the insole of the patient's footwear periodically performing:

commencing inflation of the first bladder;

commencing inflation of the second bladder following commencement of inflation of the first bladder and prior to deflation of the first bladder; and permitting deflation of the first and second bladders; and removing the bladder assembly and a controller, configured to control flow of gas from a gas source to the bladder assembly, from the patient's footwear.

16. The method of claim 15, wherein commencing inflation of the first bladder comprises actuating a first valve located in a fluid path between a gas source and the first bladder; and wherein commencing inflation of the second bladder comprises actuating a second valve located in a fluid path between the gas source and the second bladder.

17. The method of claim 16, wherein the gas source is a compressor.

18. The method of claim 17, wherein permitting deflation of the first and second bladders comprises turning off the compressor while maintaining the first and second valves in an open state permitting fluid flow between the compressor and the first and second bladders.

19. The method of claim 16, wherein the gas source is a reservoir of compressed gas.

20. The method of claim 15, further comprising maintaining both the first and second bladders in an inflated state for a first wait period and permitting deflation of the first bladder and second bladder following the first wait period.

21. The method of claim 15, wherein commencing inflation of the first bladder and commencing inflation of the second bladder include powering a compressor in fluid communication with the first and second bladders.

22. The method of claim 15, wherein the bladder assembly is in fluid communication with a gas source, the gas source operably coupled to a controller configured to control fluid flow from the gas source, the gas source and controller mounted within a housing, the method further comprising removably coupling the housing to the footwear.

23. The method of claim 22, wherein coupling the housing to the footwear comprises capturing a portion of the footwear by means of a clip secured to the housing.

24. An apparatus for promoting venous circulation in a lower extremity of a patient comprising:

a gas source;

a bladder assembly comprising a first bladder coupled to the gas source by a first fluid path and a second bladder coupled to the gas source by a second fluid path, wherein first bladder completely encircles the second bladder in a plane parallel to an insole of a patient's footwear;

a controller operably coupled to the gas source and configured to control flow of gas from the gas source to periodically commence inflation of the first bladder followed by commencement of inflation of the second bladder.

25. The apparatus of claim 24, further comprising:

a housing, the gas source and controller mounted within the housing; and a fastener secured to the housing.

26. The apparatus of claim 25, wherein the fastener comprises a resilient clip.

27. The apparatus of claim 26, wherein the fastener further comprises a first magnet secured to the resilient clip and a second magnet secured to the housing opposite the first magnet.

28. The apparatus of claim 24, further comprising a user interface in data communication with the controller.

29. The apparatus of claim 28, wherein the user interface is configured to receive frequency adjustments and pressure adjustments.

30. The apparatus of claim 29, wherein the controller is configured to allow pressure adjustments only within a predetermined pressure range and to allow frequency adjustments only within a predetermined frequency range.

31. The apparatus of claim 30, wherein the predetermined pressure range is 65 to 100 mmhg and wherein the predetermined frequency range is once every two to five minutes.

32. The apparatus of claim 24, wherein the gas source comprises a gas reservoir and wherein the first fluid path includes a first electrically controlled valve and the second fluid path includes a second electrically controlled valve; and wherein the controller is operably coupled to the first and second electrically controlled valves and configured to control opening and closing of the first and second electrically controlled valves.

33. The apparatus of claim 32, further comprising a first electrically controlled relief valve in fluid communication with the first fluid path at a point between the first electrically controlled valve and the first bladder and a second electrically controlled relief valve in fluid communication with the second fluid path at a point between the second electrically controlled valve and the second bladder;

wherein the controller is operably coupled to the first and second electrically controlled relief valves and configured to control opening and closing of the first and second electrically controlled relief valves to cause deflation of the first and second bladders.

34. The apparatus of claim 24, wherein the bladder assembly is sized to occupy an instep of the patient's footwear.

35. The apparatus of claim 24, wherein the controller is configured to control the gas source effective to:

commence inflating the first bladder following a first wait period after a previous inflation of the first bladder;

commence inflating the second bladder following a second wait period after commencement of inflation of the first bladder;

maintain the first and second bladder in an inflated state for a third wait period; and permit deflation of the first bladder and second bladder.

36. The apparatus of claim 24, wherein the gas source comprises a compressor and wherein the first fluid path includes a first electrically controlled valve and the second fluid path includes a second electrically controlled valve, the controller being operably coupled to the first and second electrically controlled valves and configured to control opening and closing of the first and second electrically controlled valves.

37. The apparatus of claim 24, wherein the gas source comprises a first compressor coupled to the first fluid path and a second compressor coupled to the second fluid path; and wherein the controller is operably coupled to the first and second compressors and configured to selectively and independently turn on the first and second compressors to control inflation of the first and second bladders.

* * * * *